United States Patent [19]

Franke

[11] 3,971,945

[45] July 27, 1976

[54] X-RAY DIAGNOSTIC APPARATUS FOR USE WITH AN X-RAY PHOTOGRAPHING DEVICE PROVIDING FOR A PRE-SET X-RAY EXPOSURE TIME

[75] Inventor: Kurt Franke, Erlangen, Germany

[73] Assignee: Siemens Aktiengesellschaft, Munich, Germany

[22] Filed: Apr. 26, 1974

[21] Appl. No.: 464,654

[30] Foreign Application Priority Data

June 4, 1973 Germany ..... 2328322

[52] U.S. Cl. ..... 250/402; 250/409

[51] Int. Cl.[2] ..... H05G 1/30

[58] Field of Search ..... 250/408, 409, 416, 413, 250/414, 402, 403, 405

[56] References Cited

UNITED STATES PATENTS

| | | | |
|---|---|---|---|
| 3,546,461 | 12/1970 | Craig | 250/416 |
| 3,585,391 | 6/1971 | Siedband | 250/409 |
| 3,634,871 | 1/1972 | Siedband | 250/416 |
| 3,746,862 | 7/1973 | Lombardo | 250/409 |
| 3,842,280 | 10/1974 | Herrick | 250/409 |

*Primary Examiner*—Craig E. Church

*Attorney, Agent, or Firm*—Haseltine, Lake & Waters

[57] ABSTRACT

An X-ray diagnostic apparatus and an auxiliary device, such as an X-ray photographing device which requires a fixedly predetermined exposure time, and which contains a control circuit for the X-ray dosage power or output with reference to a patient; a dosage output measuring arrangement; a comparator element connected to the latter for comparing the actual value of the X-ray dosage output with a reference value, which effects optimum film darkening for each particular exposure time; and adjusting means controlled by the output signal of the comparator element for adjustment of the X-ray tube voltage for equating the actual value of the dosage output with the reference value.

4 Claims, 2 Drawing Figures

X-RAY DIAGNOSTIC APPARATUS FOR USE WITH AN X-RAY PHOTOGRAPHING DEVICE PROVIDING FOR A PRE-SET X-RAY EXPOSURE TIME

FIELD OF THE INVENTION

The present invention relates to an X-ray diagnostic apparatus and for the operation of an auxiliary device, such as an X-ray photographing device, which requires a fixedly predetermined exposure time, and which contains a control circuit for the X-ray dosage power or output with reference to a patient; a dosage output measuring arrangement; a comparator element connected to the latter for comparing the actual value of the X-ray dosage output with a reference value, which effects optimum film darkening for each particular exposure time; and adjusting means controlled by the output signal of the comparator element for adjustment of the X-ray tube voltage for equating the actual value of the dosage output with the reference value.

DISCUSSION OF THE PRIOR ART

An X-ray diagnostic apparatus of the type mentioned is disclosed in German Pat. No. 1,031,436. This presently known X-ray diagnostic apparatus is, for example, applicable in connection with an X-ray contouring arrangement wherein the exposure time is previously set by means of a timing mechanism. The dosage output is thereby maintained constant during the production of an exposure, and the reference value is set so that an optimum degree of film darkening is achieved. The regulation of the disage output is effected through adjustment of the X-ray tube current. In the above-mentioned patent, there is also discussed the possibility that, for effecting the regulation of the dosage output, there may be varied other electrical operating parameters of the X-ray tube.

In order to define the quality of an exposure it is not only decisive to have an optimum film darkening, but it is also important to obtain a good image contrast. The image contrast depends upon the X-ray tube voltage. The lower the X-ray tube voltage during the production of an exposure, the better becomes the image contrast.

If the control of the dosage output is carried out merely through adjustment of the X-ray tube current then, of necessity, frequently an optimum image contrast is not obtained, since the X-ray tube is not fully utilized capacity-wise, and consequently the X-ray tube voltage does not have its lowest possible value. If, in contrast therewith, the X-ray tube voltage only is adjusted for regulating the dosage output, then similarly frequently the best possible contrast is not obtained, since also in this instance an optimum utilization of the X-ray tube capacity is not always assured.

SUMMARY OF THE INVENTION

Accordingly, it is an object of the present invention to provide an X-ray diagnostic apparatus of the hereinabove described type, in which the capacity of the X-ray tube is always utilized to its optimum extent, and with the setting, in all instances, of a relatively low X-ray tube voltage which will produce a good image or picture contrast.

The foregoing object is inventively achieved by providing means for determining the X-ray tube current in the context of setting the highest permissible X-ray tube output or power for the particular expired exposure time.

BRIEF DESCRIPTION OF THE DRAWINGS

Further advantages and details of the invention may be ascertained from the following description of an exemplary embodiment, taken in conjunction with the accompanying drawings; in which.

DETAILED DESCRIPTION

Figure 1:
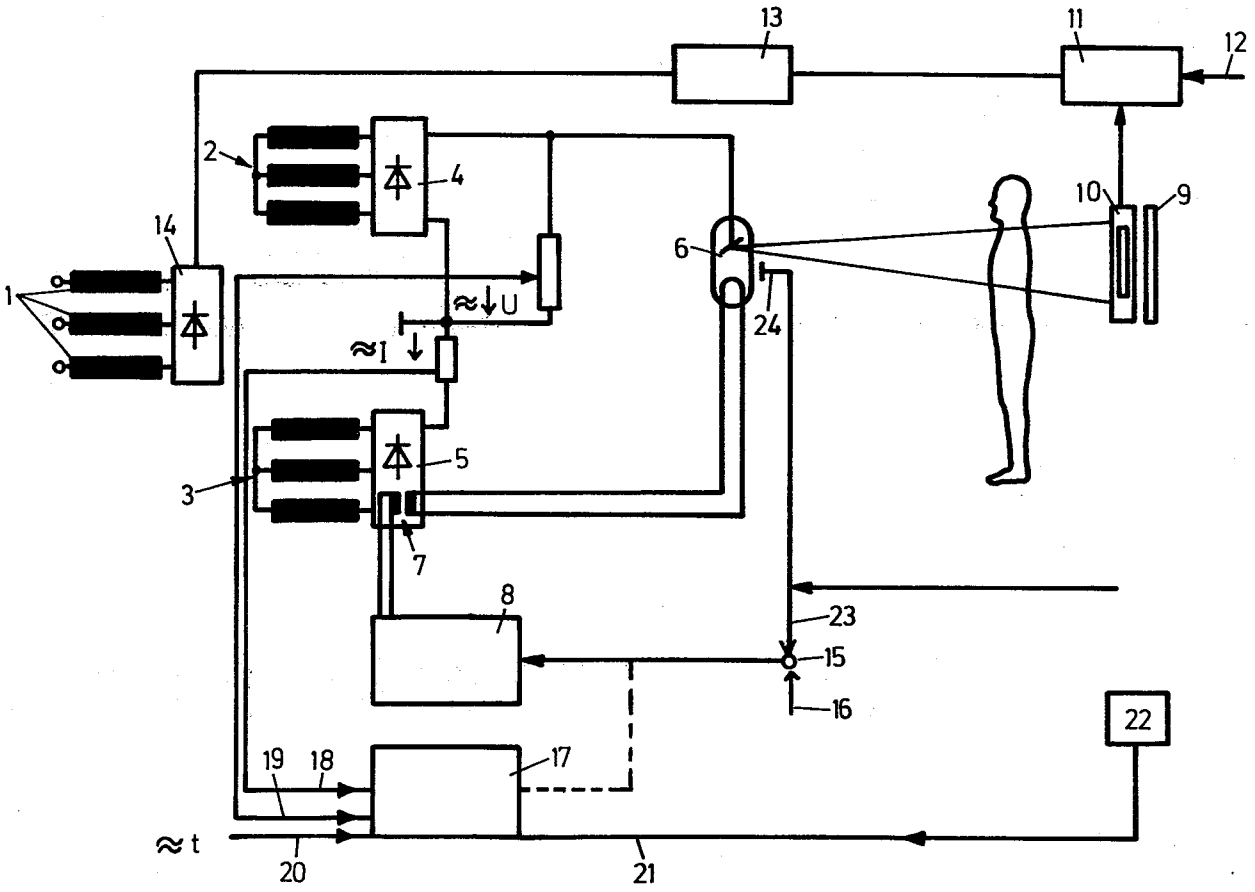
FIG. 1 shows a diagrammatic illustration of an X-ray diagnostic apparatus in accordance with the present invention.

Referring now in detail to the drawing, in FIG. 1 there is shown a three-phase, high-voltage transformer having three primary windings 1 and two groups of secondary windings 2 and 3. The secondary winding groups 2 and 3 supply two high-voltage rectifier groups 4 and 5, which are interconnected in series, and which transmit the high voltage to an X-ray tube 6. The filament voltage for the tube is generated by a heating transformer 7 which has associated therewith an adjusting or setting element 8 for the filament current and hence for the X-ray tube current.

An X-ray measuring chamber 10 is located behind the patient and before an X-ray film cassette 9 there is positioned a ray measuring chamber 10 which generates a signal in comparator element 11 corresponding to the actual value of the dosage output with reference to a patient. At the input 12 of the comparator element 11 there is applied a signal which corresponds to the reference value of the dosage output. This signal may, for example, be transmitted from a timing switch which fixedly presets the exposure time. The reference value signal provides, within the rigidly preset exposure time, an optimum degree of film darkening. The comparator element 11, through the intermediary of a kV-regulator 13, influences an electronic switch 14 which is located in the primary circuit of the high-voltage transformer, meaning in effect, that it varies the operative relationship of the switch 14 in the context of its correlation of the actual value of the dosage output or power in the X-ray tube 6 with the preset reference value.

The setting of the X-ray tube current may be accomplished in various ways. According to a first way, the setting element 8 receives an adjusting signal from a comparator element 15. The comparator element 15 receives, at an input 16 thereof, a reference value signal for the anode temperature of the X-ray tube 6. An input 23 of the comparator element 15 is connected to a measuring arrangement 24 for the anode temperature of the X-ray tube 6, and embodies thereby the actual value of this temperature. The setting element 8 always so adjusts the X-ray tube current, whereby the X-ray tube output or power concurrently has its maximum permissible value, which is preset by the maximum permissible value of the anode temperature of the X-ray tube 6, meaning in effect, the reference signal at the input 16.

For effecting the setting of the X-ray tube current, in lieu of the measuring installation 24 and the comparator element 15, there also may be provided a function generator 17 whose output signal controls the setting element 8 for the X-ray tube current. At the input 18 of the function generator 17 there is provided a signal corresponding to the actual value of the X-ray tube current, and at the input 19 a signal corresponding to the actual value of the X-ray tube voltage. At input 20 there is provided a signal which corresponds to the running of the exposure time. At the input 21 a signal is introduced to the function generator 17 which is generated by a function generator 22, and which corresponds to the X-ray tube nomograph, in effect, determines the permissible duration of the X-ray tube power in dependence upon the exposure time. The function generator 17 forms a signal from the signals at its inputs 18 through 20 which embodies the actual value of the X-ray tube power for the particular exposure time, and compares this signal with the signal at input 21. The function generator 17 thus effects through the setting element 8 an adjustment of the X-ray tube current in the context of a correlation between the actual value of the X-ray tube power at the particular exposure time with the permissible reference value provided for by the X-ray tube nomograph.

The illustrated X-ray diagnostic apparatus operates in the manner in which deviations of the actual value of the dosage output with respect to the reference value are compensated for, through the intermediary of the kV-regulator 13, by varying of the X-ray tube voltage; however, the X-ray tube current also is so adjusted by means of the setting element 8, so that the anode temperature of the X-ray tube 6 or, respectively, the X-ray tube power or output is always at its maximum permissible value. The capacity of the X-ray tube 6 is consequently always fully utilized so as to automatically generate an X-ray tube voltage which provides a good image or picture contrast. It is also important for the invention that the control circuit for the dosage output incorporates a setting element for the X-ray tube voltage, and wherein a further control circuit is provided which effects the regulating of the X-ray tube current in conformance with the preset duration of the X-ray tube output dependent upon the exposure time.

Figure 2:
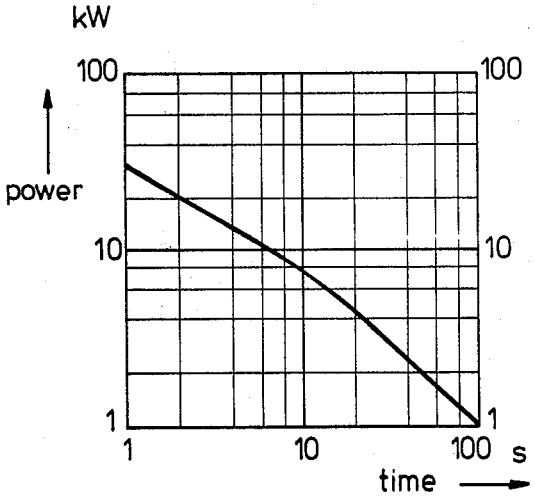
FIG. 2 shows a power-time graph representative of the installation of FIG. 1.

The electronic switch 14 may be constructed in accordance with the disclosure of German Laid-Open Specification No. 1,961,621. At the input 21 of the function generator 17 there may be provided a signal as illustrated, for example, in FIG. 2 of the drawings. FIG. 2 illustrates the permissible duration of the X-ray tube output or power as a function of the exposure time. The function generator 17 compares the signal at its input 21, which varies pursuant to FIG. 2, with the signal at its inputs 18 through 20, and consequently influences the X-ray tube current in the above-described manner. The generation of the signal pursuant to FIG. 2 at the input 21 may be carried out in the function generator

22 through the discharging of capacitors which are switched together so as to attain the desired voltage sequence according to FIG. 2. The voltage regulator or setting element 8 may be constructed as disclosed in U.S. Pat. No. 2,962,594.

While there has been shown what is considered to be the preferred embodiment of the invention, it will be obvious that modifications may be made which come within the scope of the disclosure of the specification.

What is claimed is:

1. In an X-ray diagnostic apparatus for the operation of an X-ray photographing device requiring a fixedly preset exposure time for X-ray image; a control circuit for the X-ray dosage power with reference to a patient, said control circuit including dosage output measuring means, comparator means connected to said measuring means adapted to compare the actual value of the dosage output with a reference value, said control circuit effecting an optimum film darkening for a particular exposure time, and setting means for the voltage of an X-ray tube in said apparatus controlled by an output of said comparator means for correlating the actual value of said dosage power with the reference value, the improvement comprising means in said control circuit for determining and adjusting the X-ray tube current so as to always automatically generate the highest permissible X-ray tube power output for a particular transpired exposure time.

2. An apparatus as claimed in claim 1, comprising a second setting means for adjustment of the X-ray tube current, said comparator means being adapted to transmit a signal to said second setting means for adjusting the X-ray tube current, said comparator means having a plurality of inputs each receiving signals dependent upon, respectively, the instantaneous actual value of the X-ray tube output, the transpired exposure time, and the shape of X-ray tube output in dependence upon the exposure time determined by a preset X-ray tube nomograph.

3. An apparatus as claimed in claim 2, comprising a function generator for formulating said signal embodied by the X-ray tube nomograph.

4. An apparatus as claimed in claim 1, comprising a second setting means for adjustment of the X-ray tube current, said comparator means being adapted to transmit a signal to said second setting means, said comparator means receiving input signal embodying the actual value and reference value of the anode temperature of said X-ray tube.

* * * * *